US005855423A

United States Patent [19]

Cram

[11] Patent Number: 5,855,423

[45] Date of Patent: Jan. 5, 1999

[54] FLAT FILE CABINET WITH DRAWER INTERLOCK

[75] Inventor: Ronald Cram, Whittier, Calif.

[73] Assignee: Planhold Corporation, Irvine, Calif.

[21] Appl. No.: 21,778

[22] Filed: Feb. 11, 1998

Related U.S. Application Data

[60] Provisional application No. 60/058,726, Sep. 12, 1997.

[51] Int. Cl.[6] ..... E05C 7/06; E05B 65/46

[52] U.S. Cl. ..... 312/221; 312/216

[58] Field of Search ..... 312/221, 216, 312/217, 222, 107.5, 334.12, 220

[56] References Cited

U.S. PATENT DOCUMENTS

| | | | |
|---|---|---|---|
| 4,272,138 | 6/1981 | Stark | 312/216 X |
| 4,441,767 | 4/1984 | Stark | 312/216 |
| 4,865,404 | 9/1989 | Harper | 312/221 |
| 5,352,030 | 10/1994 | Derle et al. | 312/221 |
| 5,411,327 | 5/1995 | Norton | 312/216 X |
| 5,599,077 | 2/1997 | Law et al. | 312/221 |
| 5,634,701 | 6/1997 | Hendrich et al. | 312/222 X |

FOREIGN PATENT DOCUMENTS

| | | | |
|---|---|---|---|
| 1299571 | 12/1972 | United Kingdom | 312/334.19 |
| 2095322 | 9/1982 | United Kingdom | 312/221 |

*Primary Examiner*—Peter M. Cuomo

*Assistant Examiner*—James O. Hansen

*Attorney, Agent, or Firm*—Schweitzer Cornman Gross & Bondell LLP

[57] ABSTRACT

A flat file cabinet has a plurality of removable drawers slidably supported by a frame and bearings. Each drawer includes an interlocking channel on a side of the drawer which actuates a vertical column of independent locking bars slidably supported by the frame. Each locking bar includes a roller means which is urged upwardly by and rides on top of the interlocking channel when a drawer is partially withdrawn. Each locking bar also includes a pin means normally located slightly below the interlocking channel. When the roller is urged upward it displaces the locking bar to which it is connected, and all locking bars thereabove, upward into a displaced position in which the pins interfere with the locking channels of the above drawers, preventing forward movement of the above drawers. The interlocking channel of the withdrawn drawer also prevents upward travel of the pin of the locking bar located immediately therebelow thereby preventing the forward movement of all drawers below. The vertical movement of the locking bars is limited by a face plate located between the column of locking bars and the drawer. The face plate includes elongated slots through which the rollers and pins extend. The face plate provides that any number of drawers can be removed from the frame while maintaining the normal operability of the interlocking mechanism for the remaining drawers. The interlocking channels include tapered forward and rear ends to permit withdrawal and removal, respectively, of the drawers.

1 Claim, 5 Drawing Sheets

FLAT FILE CABINET WITH DRAWER INTERLOCK

This application claims the benefit of U.S. provisional application No. 60/058,726, filed Sep. 12, 1997.

FIELD OF THE INVENTION

This invention relates to the field of filing cabinets and, in particular, to flat file cabinets with removable drawers suitable for storage of large-format, flat items.

BACKGROUND AND SUMMARY OF THE INVENTION

Flat file cabinets are commonly used to store and organize large-format, flat items, such as maps, architectural drawings and the like. The drawers of flat file cabinets are typically less than 3 inches high and have a relatively shallow holding capacity. However, each cabinet typically includes several such drawers arranged in a vertical column such that any one flat file cabinet can hold a large number of items.

To accommodate customary practice, the drawers of flat file cabinets are intentionally designed to be easily removable from and replaceable to the frame such that the items therein can be inspected at another location. In for example a library setting, this typically means removing the drawer from the flat file cabinet and taking it to a nearby table or stand. Therefore, the sliding support structure of the conventional flat file cabinets is designed to allow easy removal and replacement of the drawers.

The drawers are typically supported on frame bearings fixed to the frame which cooperate with drawer tracks attached to the drawers and drawer bearings attached to the drawers which cooperate with frame channels fixed to the frame. Typically, to remove a drawer, the drawer is first withdrawn, then the outward end of the drawer is lifted upward such that the drawer is oriented at an inclined angle. Then the drawer is withdrawn generally parallel to its angle of incline until free from the sliding support structure and frame. The drawer is replaced in the opposite motion.

To retain the drawers in the fully closed positions, the frame channels typically include slots or recesses adjacent the rearward ends thereof which cooperate with the drawer bearings affixed to the drawer. Specifically, when a drawer is fully closed, the drawer bearing drops into the slots or recesses in the frame channel, thereby somewhat inhibiting the movement of the drawer. It can be appreciated, however, that the cooperation of the slots and recesses and the drawer bearing provide only a limited amount of resistance to the movement of the drawer. This limited resistance is easily overcome by outward pressure on the drawer or a disturbance of the frame. Thus, drawers can open unintentionally, and moreover, multiple drawers can open simultaneously which can cause the frame to become unstable and fall over. Therefore, what is desired is a flat file cabinet which provides a means to interlock the various drawers thereof such that only one drawer may open at a time while retaining the ability to easily remove and replace the drawers in accordance with the common use of such flat file cabinets.

The flat file cabinet of the present invention provides a drawer interlocking system which prevents the simultaneous withdrawal of more than one drawer while retaining the ease and ability of temporarily removing and then replacing a drawer for inspection of the items contained therein. Specifically, the flat file cabinet includes a vertical column of locking bars slidably supported by the frame of the cabinet adjacent the front thereof. The locking bars include a pin and a roller at opposite ends thereof, which cooperate with interlocking channels affixed to the sides of the drawers. Each interlocking channel includes a tapered, arrow-shaped portion on the forward end thereof which cooperates with the roller of an associated locking bar to separate and displace the locking bars when the drawer is withdrawn. As will be discussed further below, the displacement of the adjacent locking bars prevents any other drawer from opening.

The interlocking mechanism is specifically designed to allow the normal operation of the flat file cabinet. Specifically, the drawers can be removed from the filing cabinet in a manner similar to prior designs by simply withdrawing the drawer, lifting the front end upward, then removing the drawer generally parallel to the angle of incline of the drawer until free from the support structure and frame. The removed drawer is replaced with an opposite motion. Importantly, when a drawer is fully removed, the locking bars return to a normal or rest position and function to provide the normal interlocking function for the remaining drawers.

BRIEF DESCRIPTION OF THE DRAWINGS

For a complete understanding of the above and other features of the invention, reference shall be made to the following detailed description of the preferred embodiments of the invention and to the accompanying drawings, wherein.

DETAILED DESCRIPTION OF THE INVENTION

Figure 1:
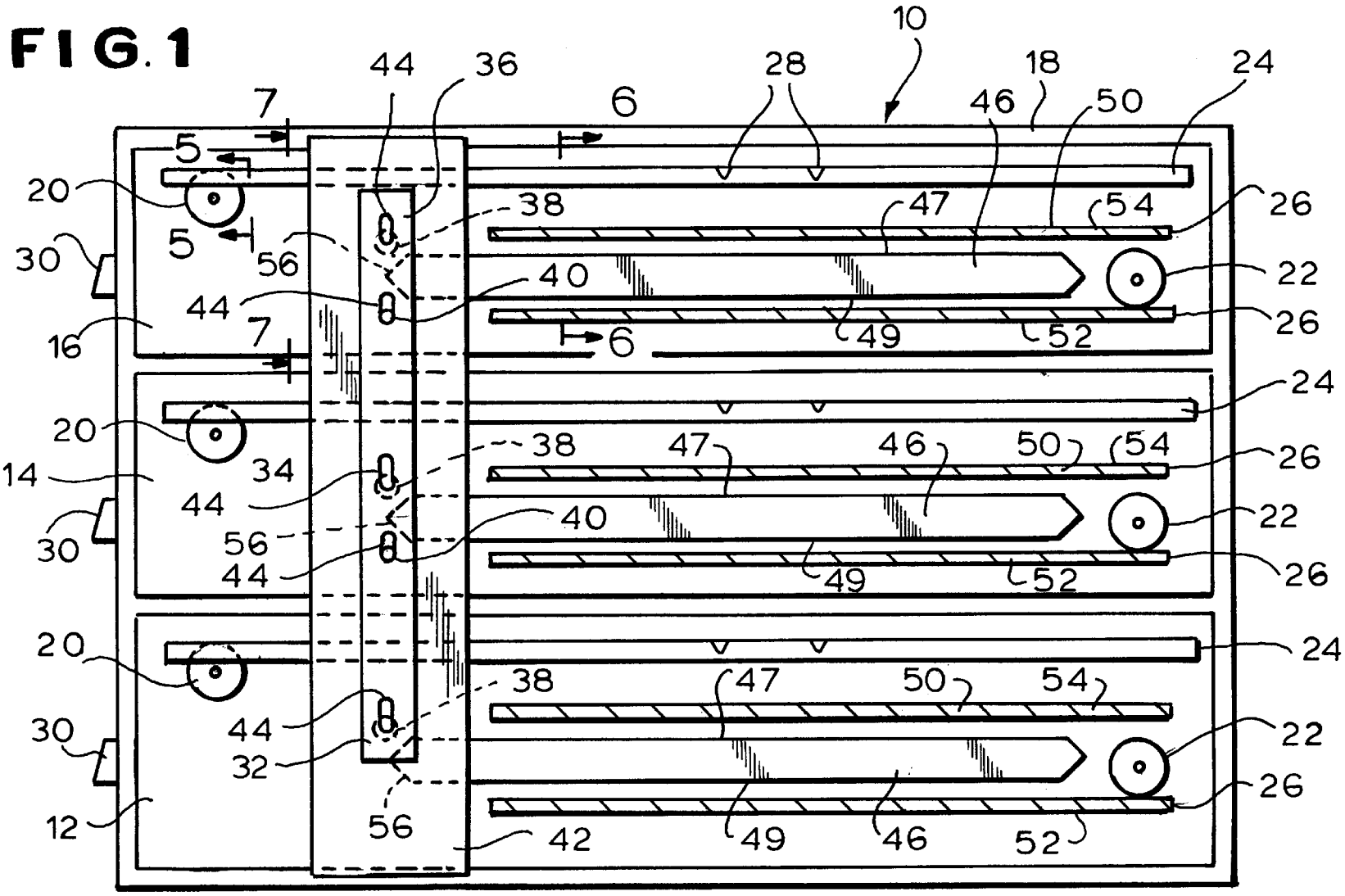
FIG. 1 is a cross-sectional, side, elevational view of the flat file cabinet of the present invention, showing all drawers in the closed position.

Referring to the drawing, and initially to FIG. 1 thereof the flat file cabinet 10 of the present invention includes a plurality of drawers 12, 14, 16, which will be referred to herein respectively as the bottom drawer 12, middle drawer 14 and top drawer 16. In the embodiment herein described, the flat file cabinet 10 includes three drawers. However the invention is equally applicable to such cabinets with any number of a plurality of drawers.

Figure 5:
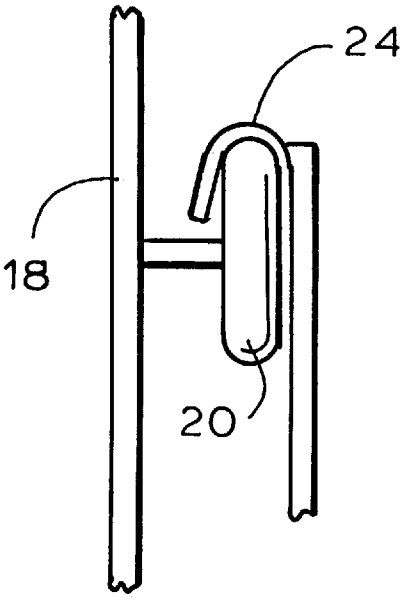
FIG. 5 is a cross-sectional, elevational view taken along line 5—5 of FIG. 1.

In any configuration, each drawer 12, 14, 16 is slidably supported to a frame 18 by a frame bearing 20, affixed to the frame 18, and a drawer bearing 22, affixed to the respective drawer. A drawer track 24 (best seen in FIG. 5) affixed to each drawer 12, 14, 16, moves over the frame bearing 20 when the drawer is withdrawn. The drawer bearing 22 rolls along a frame channel 26, affixed to the frame 18. The drawer track 24 can include indentations 28 at an intermediate portions to inhibit the movement of the drawer when in a certain position, such ⅔ open. The frame channel can also include a slot or recess (not shown) in a rearward end to inhibit movement of the associated drawer when completely closed. A handle 30 is typically included to articulate the drawers 12, 14, 16.

The flat file cabinet also includes a plurality of locking bars 32, 34, 36 slidably supported in a vertical column in the frame 18. Preferably, there is one locking bar for each drawer 12, 14, 16, Connected to the locking bars 32, 34, 36 is either one or both of a roller 38 and a pin 40, both of which extend inwardly in FIG. 1 and are therefore depicted in ghost lines. As can be seen, the uppermost locking bar 36 need not include a pin.

Between the locking bars 32, 34, 36 and the rollers 38 and pins 40 is a preferably unitary face plate 42 which includes vertically-aligned, oval slots 44 through which the axles (not shown) of the rollers 38 and pins 40 extend. The face plate 42 and slots 44 therein serve to confine the locking bars 32, 34, 36 to vertical motion within the column shown and to limit the distance which they can travel. As shown, the locking bars 32, 34 and 36 are in what will be termed a rest position in which the pins 40 and rollers 38 are at the bottom of the slots 44. This is the position of the locking bars 32, 34, 36 when no drawer is partially withdrawn. That is, when all drawers are either completely closed or completely removed from the frame 18.

Figure 4:
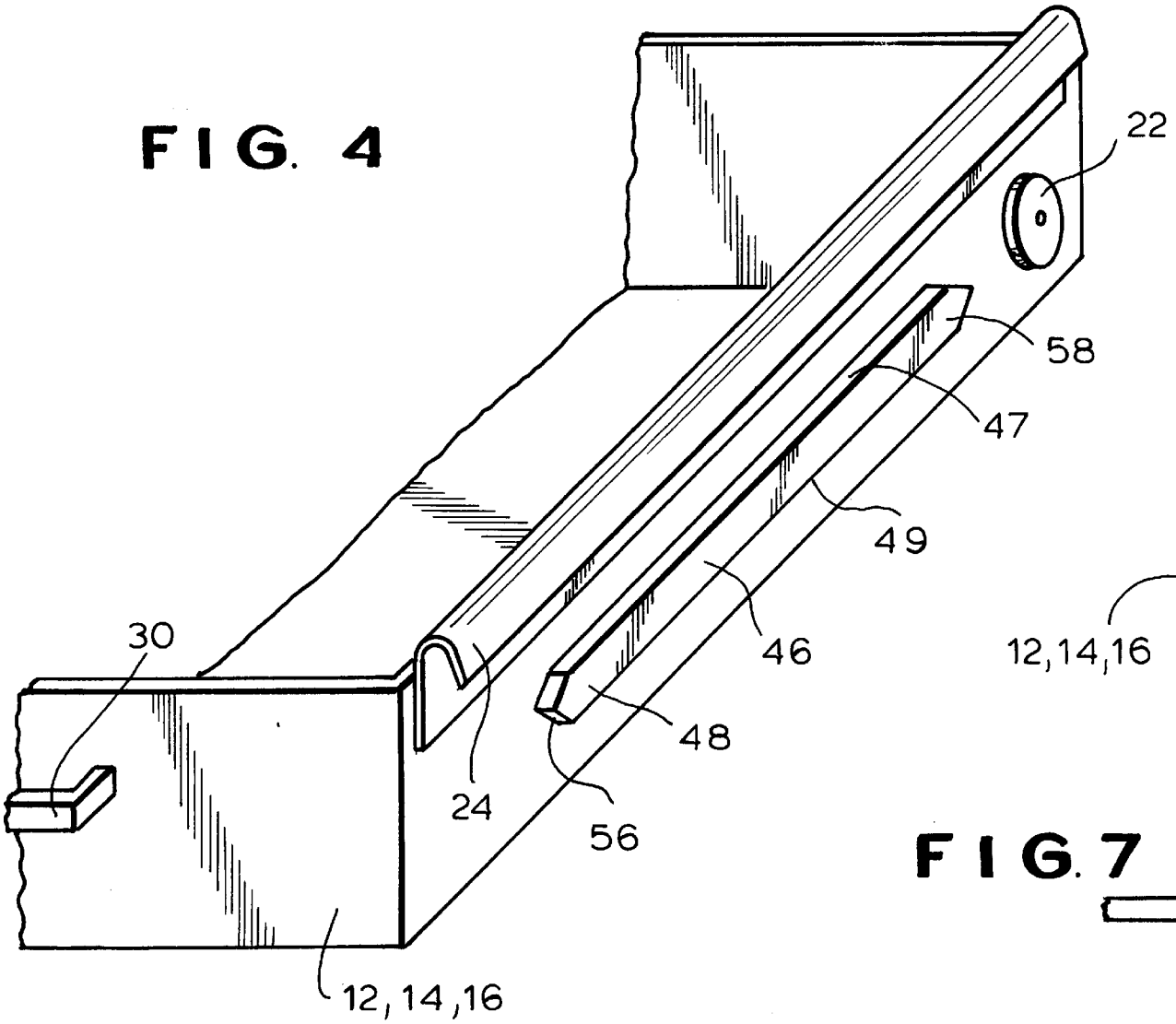
FIG. 4 is a perspective view of a drawer of the file cabinet of FIG. 1, illustrating the interlock channel affixed to the drawer.

Fixedly attached to the side of each drawer is a interlocking channel 46 (best seen in FIG. 4) which actuates the locking bars 32, 34, 36 via the rollers 38 connected thereto. Each interlocking channel 46 includes a forward end 48 which has an inclined configuration such as the point or arrow-shape depicted. The forward end 48 is configured to urge a roller 38 upward, along with the associated locking bar and all locking bars thereabove. Once urged upward, the roller 38 "rides" in place along the upper surface 47 of the interlocking channel 46 as the drawer is withdrawn. Preferably the tip of the forward end 48 is located closely adjacent or forwardly of an imaginary line passing through the rollers 38 and pins 40.

A lower surface 49 and the upper surface 47 of each interlocking channel are spaced apart a distance greater than the minimum distance between an adjacent roller-pin pair when the associated locking plates are in contact with one another (i.e., greater than the distance between the top of a pin and the bottom of an adjacent roller).

Figure 6:
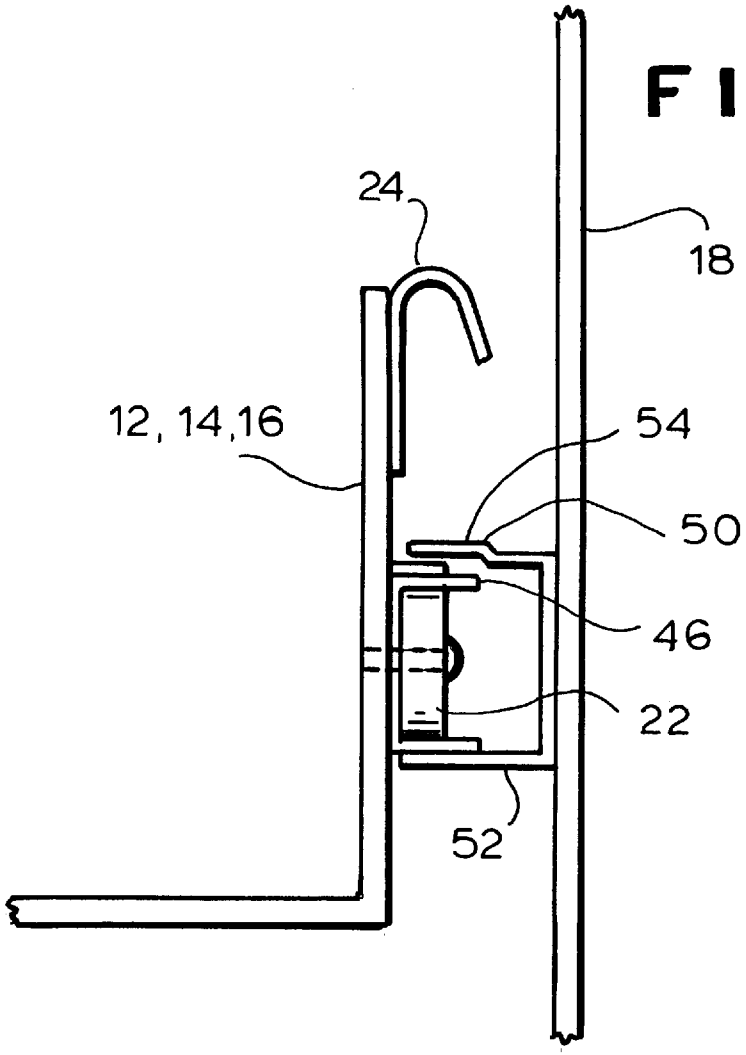
FIG. 6 is a cross-sectional, elevational view taken along line 6—6 of FIG. 1.

Attached to the frame 18, and associated with each drawer 12, 14, 16 is a preferably unitary frame channel 50 which extends above and below the interlocking channel 46 of the drawers and which provides rolling surfaces for the drawer bearings 22 the associated drawer. Lower and upper portions 52, 54 of the frame channel 50 are spaced to substantially confine the drawer bearing 22 to lateral motion such that the drawer does not tip or rock about the frame bearing 20 during movement. The frame channel 50 extends rearward a sufficient distance to support the drawer bearing 22 when the drawer is fully closes, and terminates a distance from rollers 38 of the locking bars 32, 34, 36. As best seen in FIG. 6, small gaps preferably exist between the upper and lower surfaces 47, 49 of the interlocking channel and the upper and lower portions 54, 52 of the frame channel 50, respectively, such that, under normal conditions no interference is created between these parts.

Figure 7:
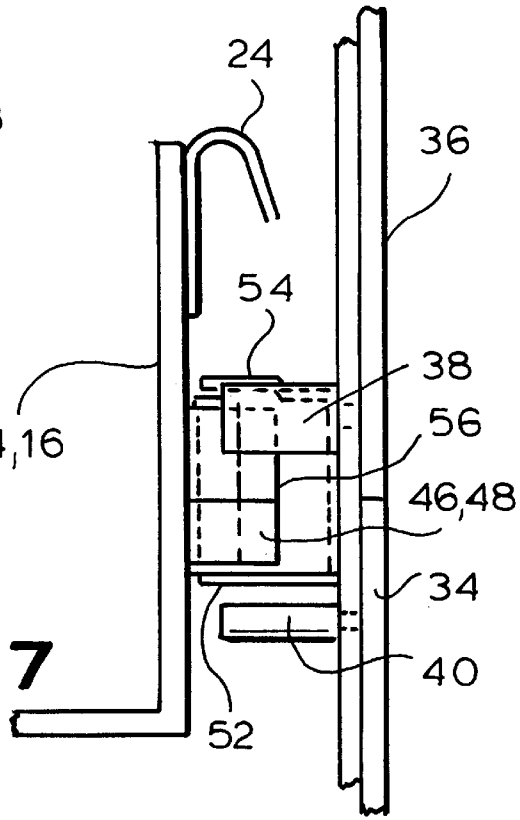
FIG. 7 is a cross-sectional, elevational view taken along line 7—7 of FIG. 1.

Under the normal or rest conditions depicted in this FIG. 1, the locking bars 32, 34, 36 are urge downward, under the force of gravity, such that the rollers 38 and pins 40 rest at the bottoms of the slots 44 in the face plate 42. As best seen in FIG. 7, in this rest position, the rollers 38 are located below the upper surfaces 47 of the interlocking channel and above the apex or point 56 of the forward end 48 thereof, such that if a drawer is withdrawn, it will urge the associated roller 38 upward. In the rest position, the pins 40 are located slightly below the lower surfaces 49 of the interlocking channels 46 such that, if a drawer immediately thereabove is withdrawn, the pin 40 will not interfere with the interlocking channel 46. As can be seen, the slots 44 in the face plate 42 extend upwardly from the rollers 38 and pins 40, when in the rest position, indicating that the locking bars 32, 34, 36 are in the lowest position.

Figure 2:
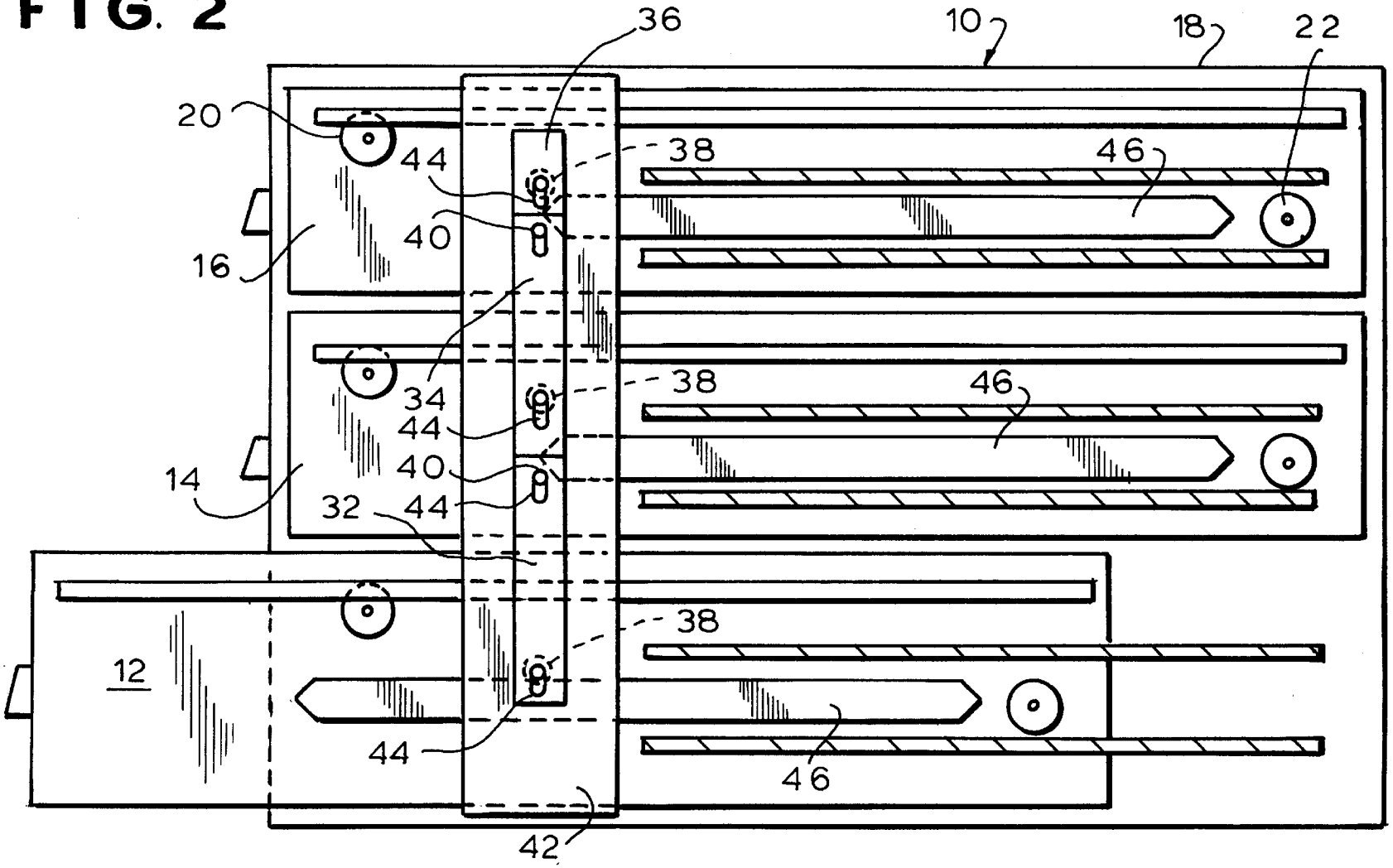
FIG. 2 is a cross-sectional, side, elevational view of the flat file cabinet of FIG. 1, showing a bottom drawer in a withdrawn position.

Referring to FIG. 2, when the bottom drawer 12 is withdrawn, the interlocking channel 46 thereof urges all of the locking bars 32, 34, 36 upward into a displaced position. In this displaced position, the rollers 38 and pins 40 are closely adjacent the top of the slots 44 of the face plate 42 and cannot move upward any substantial amount. The pins 40 are in line to interfere with the interlocking channels 46 of the middle 14 and top drawers 16. If an attempt is made to open either the middle 12 or top drawer 14, the associated pin 40 will cause the interlock channel 46 of the drawer to ride up on the pin 40. This closes the gap between the interlocking channel 46 and the upper surface of the frame channel 50 causing an interference between the interlocking channel 46 and the frame channel 50 and preventing the further forward movement of the drawer.

In addition, the distance between the roller 38 and pin 40 pairs associated with the unopened drawers 14, 16 is less than the height of the interlocking channel 46. The roller 38 cannot move upward because its motion is limited by the associated slot 44 in the face plate 42. The pin 40 cannot move downward because it is being elevated by the bottom drawer 12 withdrawn below. Therefore, the neither the middle drawer 14 nor the top drawer 16 can be opened while the bottom drawer is partially withdrawn. It can be appreciated, however, that if the bottom drawer 12 is completely removed from the frame 18, the locking bars would resume the rest position. Thereafter, the drawers and interlocking mechanism would operate as normal for the remaining drawers.

Figure 3:
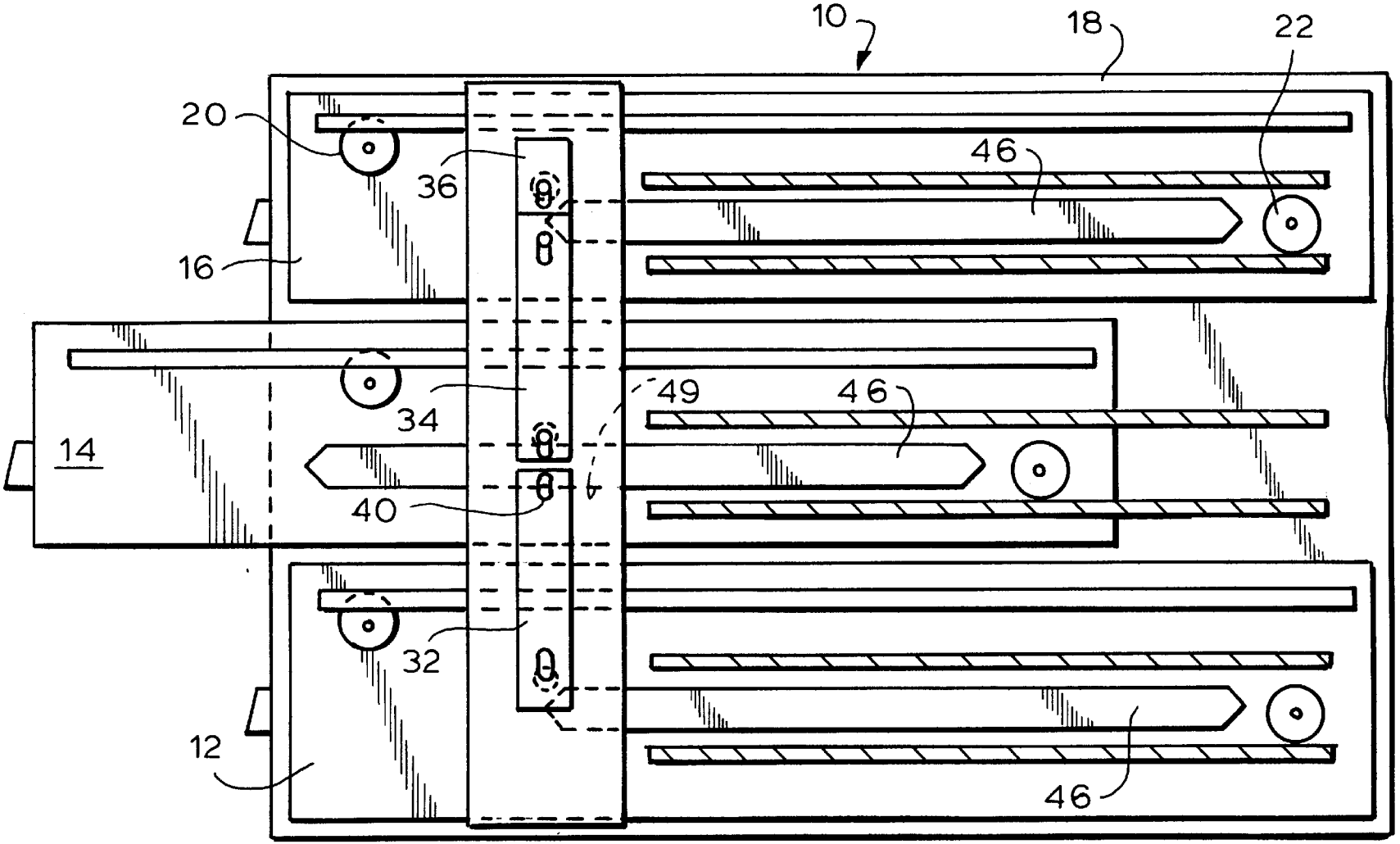
FIG 3 is a cross-sectional, side, elevational view of the flat file cabinet of FIG. 1, showing a middle drawer in a withdrawn position.

Referring to FIG. 3, if the middle drawer 14 is partially withdrawn, only the locking bars 34, 36 above the middle drawer 14 would be urged upward. The locking bar 32 below the middle drawer 14 would remain in place. The top drawer 16 in this instance is locked as it would be in the scenario depicted in FIG. 2. The bottom drawer 12 is unable to move because the locking bar 32 cannot be urged upward since movement of the pin 40 connected thereto is prevented by the lower surface 49 of the interlocking channel 46 of the middle drawer 14, shown partially withdrawn. Thus, both the bottom 12 and top 16 drawers are locked closed. However, as above, it can be appreciated that, if the middle drawer 14 is completely removed from the frame 18, the interlocking bars 32, 34, 36 will return to the rest position and will provide interlocking for the remaining drawers in the normal fashion.

As indicated, an important feature of the present invention is the ability to easily remove and replace a drawer for inspecting or managing the contents. Therefore, the interlock channel 46 of each drawer 12, 14, 16 includes a rearward end 58 which has an inclined or arrow-shaped portion 60 similar to that on the forward end 48. This allows the drawer 12, 14, 16 to be re-inserted into the frame after removal. Thus, when replacing a drawer 12, 14, 16, the associated interlock channel 46 will temporarily displace the interlocking bars thereabove until the drawer is closed, at which time the locking bars 32, 34, 36 will return to the rest position.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed:

1. A flat file cabinet with an interlocking mechanism, comprising:

(a) a frame having upper and lower frame bearings affixed adjacent a front thereof and having upper and lower horizontally-disposed frame channels with substantially parallel, spaced-apart upper and lower portions extending inwardly from said frame;

(b) an upper drawer and a lower drawer slidably supported by said frame, each drawer having:

(i) a drawer bearing affixed to a rearward end thereof, said drawer bearing being configured and located to travel within said frame channel when said drawer is moved relative to said frame;

(ii) a horizontally disposed drawer channel, said drawer channel being configured to travel over said frame bearing when said drawer is moved relative to said frame; and (iii) a horizontally disposed interlocking channel extending outwardly from a side of said drawer, said interlock channel having a tapered forward end;

(d) said interlocking channel of said lower drawer having a rearward end which is tapered;

(e) said upper and lower interlocking channels being configured to travel between said upper and lower portions of said upper and lower frame channels, respectively, (e) a locking bar slidably supported by said frame, said locking bar having an inwardly-extending roller means and an inwardly-extending pin means located above said roller means;

(f) a face plate fixedly attached to said frame, said face plate being located between said locking bar and said drawers and having an upper and lower elongated slot therein, said roller means extending through said lower slot and said pin means extending through said upper slot, said slots being configured to provided a predetermined amount of vertical travel for said locking bar;

(g) said locking bar having a rest position in which said roller means and said pin means are in contact with a bottom of said respective slots, and having a displaced position in which said roller means and said pin means are in contact with a top of said respective slots;

(h) when said locking bar is in said rest position, a first distance being the difference between a height of a lowest portion of said roller means and a height of an upper surface of said interlocking channel of said lower drawer, and a second distance being the difference between a height of a highest portion of said pin means and a height of a lower surface of said interlocking channel of said upper drawer;

(i) when only said lower drawer is partially withdrawn, said interlocking channel of said lower bar being configured to urge said roller means, and thereby said locking bar and said pin means, upward into said displaced position;

(j) when in said displaced position, said highest portion of said pin means being in an interference position above a height of said lower surface of said interlocking channel of said upper drawer to prevent forward movement of said upper drawer;

(k) said first distance being greater than said second distance to prevent the forward movement of said lower drawer when only said upper drawer is partially withdrawn; and (l) said upper and lower drawers being removable from said frame, and said tapered rearward portion of said interlocking channel of said lower drawer being adapted to urge said roller means into said displaced position when said lower drawer is being replaced.

* * * * *